US005651045A

United States Patent [19]

Pouvesle et al.

[11] Patent Number: 5,651,045

[45] Date of Patent: Jul. 22, 1997

[54] X-RAY PULSE GENERATOR

[75] Inventors: Jean-Michel Pouvesle, St Mesmin; Christophe Cachoncinlle, Orleans; Raymond Viladrosa, Darvoy, all of France

[73] Assignee: Centre National de la Recherche Scientifique, France

[21] Appl. No.: 532,642

[22] PCT Filed: Mar. 29, 1994

[86] PCT No.: PCT/FR94/00349

§ 371 Date: Dec. 26, 1995

§ 102(e) Date: Dec. 26, 1995

[87] PCT Pub. No.: WO94/23552

PCT Pub. Date: Oct. 13, 1994

[30] Foreign Application Priority Data

Mar. 30, 1993 [FR] France ..... 93 03670

[51] Int. Cl.[6] ..... H01J 35/00

[52] U.S. Cl. ..... 378/119; 378/101; 378/102

[58] Field of Search ..... 378/119, 101, 378/102–105, 106–112, 121

[56] References Cited

U.S. PATENT DOCUMENTS

| | | | |
|---|---|---|---|
| 3,363,102 | 1/1968 | Barbour | 378/103 |
| 3,681,604 | 8/1972 | Criswell et al. | 250/93 |
| 4,070,579 | 1/1978 | Brewster | 250/402 |
| 4,578,805 | 3/1986 | Pearlman et al. | 378/119 |

FOREIGN PATENT DOCUMENTS

| | | |
|---|---|---|
| A59282193 | 8/1973 | Australia . |
| 2198316 | 7/1973 | France . |
| 2109987 | 7/1978 | United Kingdom . |

OTHER PUBLICATIONS

Applied Physics Letter, vol. 52, No. 5, 1 Fevrier 1988, pp. 354–355, P. Krehl, Pulse Compression Effect in a Laser Driven Flash X–Ray Tube.

Review of Scientific Instruments, vol. 61, No. 5, May 1, 1990 NY pp. 1448–1456, J.J. Coogan, et al. Production of High–Energyphotons from Flash X–Ray Sources Powered by Stacked Blumlein Generators.

Review of Scientific Instruments, vol. 59, No. 10, Oct. 1, 1988 NY pp. 2260–2264, F. Davanloo et al. Flash X–Ray Source Excited by Stacked Blumlein Generators.

*Primary Examiner*—Don Wong
*Attorney, Agent, or Firm*—Cesari and McKenna

[57] ABSTRACT

A X-ray pulse generator for scientific, medical and industrial applications comprises a high-voltage source, a X-ray emitting head which is able to produce X-rays when it receives an electric pulse, a plurality of electric lines between the source and the head, a charge store for storing the electric power supplied by the source and a trigger for releasing the electric power stored in the store and triggering the pulse which is then transferred to the head by the electric lines. These lines are wound and are on one side are connected in parallel to the store and on the other side are connected in series to the head.

11 Claims, 4 Drawing Sheets

X-RAY PULSE GENERATOR

DESCRIPTION

The present invention relates to a X-ray pulse generator.

Its applications are scientific, industrial and medical, such as e.g. crystallography, radiography and sterilization.

1. Background of the Invention

A X-ray pulse generator is already known from U.S. Pat. No. 5,044,004 (Collins et al) entitled "Flash X-ray Apparatus".

This known generator comprises a plurality of Blumleins connected between a high voltage source associated with a thyratron and a X-ray emitting head. However, such Blumleins are electric lines which are rectilinear and rigid and have a considerable length, so that the generator has large overall dimensions and the X-ray emitting head is either stationary or only slightly mobile.

2. Summary of the Invention

The present invention solves the problem of the design of a X-ray pulse generator having smaller overall dimensions than the known generator.

In order to solve this problem, the X-ray pulse generator according to the invention comprises:

a high voltage source, a X-ray emitting head able to produce X-rays when it receives an electric pulse and a plurality of electric lines between the high voltage source and the X-ray emitting head, each electric line comprising a first electrical conductor and a second electrical conductor separated by a dielectric, characterized in that it also comprises:

means for storing the electric power supplied by the high voltage source and triggering means for releasing the electric power stored in the storage means and for triggering the electric pulse, which is then transferred to the X-ray emitting head by means of the electric lines, and in that said electric lines are wound and are on one side connected in parallel to the electric power storage means and on the other side are connected in series to the X-ray emitting head.

The generator according to the invention is able to emit over very short times (equivalent to the length of the pulse), a much more intense X-radiation than that emitted by the conventional generators generally used in laboratories and in industry.

Moreover, the use of wound electric lines makes it possible to produce a small generator, which can be placed on a table and transported by one person.

Preferably, the electric lines of the generator according to the invention all have the same length, in order to obtain a good quality factor.

The generator according to the invention can also incorporate a plurality of parallel, electrically insulating supports, which are juxtaposed and respectively associated with the wound electric lines, each support having a groove in which the corresponding electric line is wound.

In order to reduce the corona effect, the generator according to the invention preferably also has means for pressing the supports against one another. To further decrease said corona effect, the lines are preferably coated in the grooves with an electrically insulating material.

Each line can be wound in a spiral or double spiral. Preferably, each line is a flexible coaxial cable, the first and second electrical conductors of said line being respectively constituted by the core and the braid of said coaxial cable. Such flexible coaxial cables are commercially available, which simplifies the manufacture of the generator according to the invention.

According to a particular embodiment of the generator according to the invention, each line is a spirally wound, flexible, coaxial cable, the first and second electrical conductors of said line being respectively constituted by the core and the braid of said coaxial cable, the spiral winding of each cable taking place on moving towards the center of the corresponding support and the supports are perforated in their central portion in order to permit the passage of cables from the side where the cables are connected to the electric power storage means to the supports respectively corresponding thereto.

Preferably, part of the flexible coaxial cables connected to the X-ray emitting head is left free to permit the mobility of said emitting head with respect to the remainder of the generator. This facilitates the implementation of the generator according to the invention.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENTS

Figure 1:
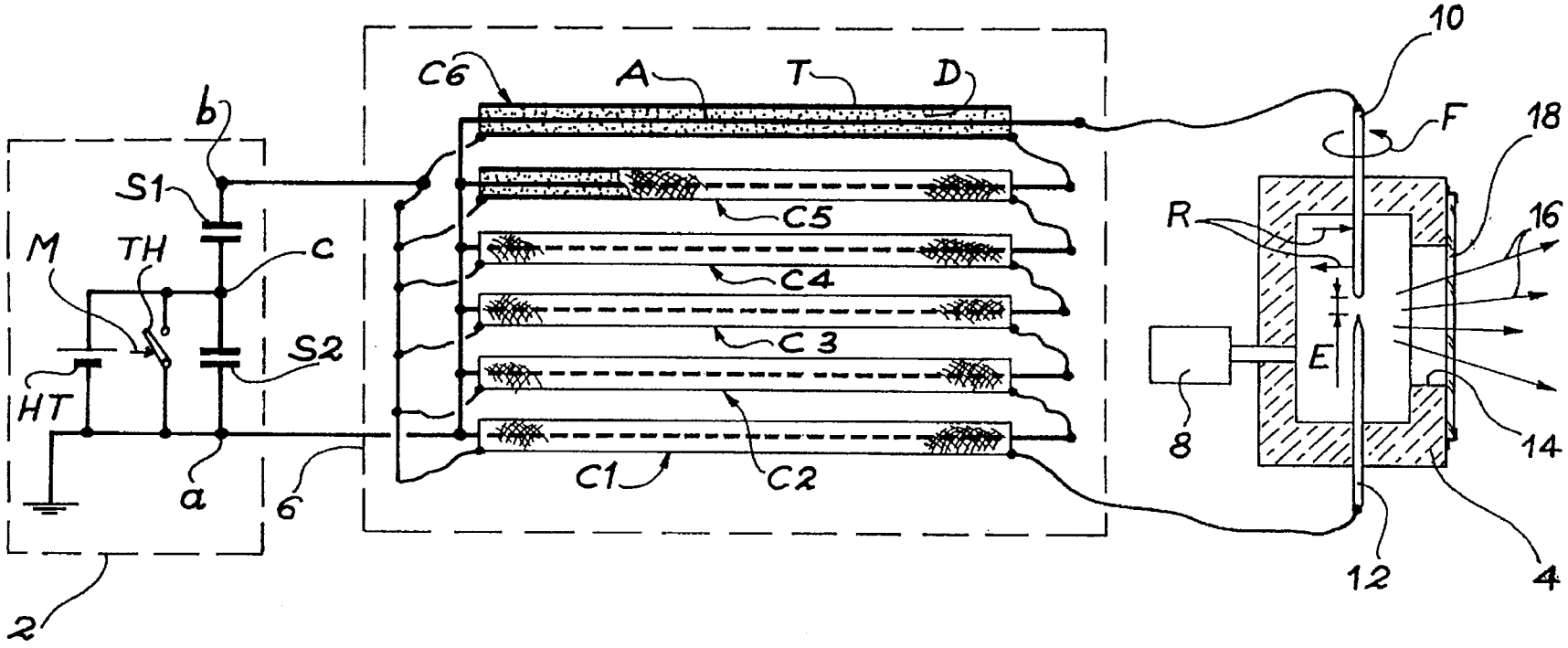
FIG. 1 An electric diagram of a generator according to the invention.

The X-ray pulse generator diagrammatically shown in FIG. 1 comprises means 2 for forming electric pulses, a X-ray emitting head 4 and a cable generator 6 connecting the means 2 to the head 4.

These means 2 provided for supplying electric pulses comprise a high voltage source HT, two storage capacitors S1 and S2 for storing the electric power supplied by the high voltage source HT and triggering means TH for releasing the electric power stored in the storage capacitors and for triggering an electric pulse, said triggering means TH being controlled by means symbolized by an arrow M in FIG. 1.

As can be seen in FIG. 1, the storage capacitors S1 and S2 are connected in series, the capacitor S2 being connected between the terminals of the high voltage source HT and triggering means TH are also fitted between these terminals of the high voltage source HT.

Said source HT can be a constant high voltage source or a pulse-type high voltage source (in which case the electric pulse, on entering the cable generator, is triggered when the charge of the capacitors S1 and S2 reaches a desired value).

In a purely indicative and in no way limitative manner, use is made of a high voltage source which can vary between 0 and 40 kV and which is able to recharge the capacitors S1 and S2 to frequencies which can vary between 0.1 Hz and 1 kHz, as a function of the desired configuration.

The capacitors S1 and S2 can be discreet capacitors also known as disk capacitors, or can be planar or flat lines or even coaxial cables.

The triggering means TH comprise a single fast discharger for high voltage, such as e.g. a thyratron or spark gap, or a discharger known under the name pseudo-spark, or a rotary discharger, which reduces the power losses and increases efficiency.

In a purely indicative and in no way limitative manner, use is made of triggering means able to operate between 0.1 Hz and 1 kHz.

The X-ray emitting head 4 is tight and made from an electrically insulating material such as e.g. glass, ceramic, Plexiglas, polycarbonate, polyvinyl chloride or polysulphone. If necessary, said emitting head 4 can be enveloped with a fine X-ray absorption envelope, which can be made from lead.

Pumping means 8 tightly communicate with the interior of the emitting head 4 in order to form the vacuum.

It is pointed out in this connection that the duration of a X-ray pulse obtained in the manner indicated hereinafter is a function of the residual pressure within the emitting head 4.

The emitting head 4 is provided with an anode 10 and a cathode 12 positioned facing one another in the emitting head 4 and which traverse the walls thereof by tight passages. The electric discharges leading to the formation of X-rays take place between the anode and the cathode.

The emitting head 4 is provided with an orifice 14 facing the space between the anode and the cathode in order to permit the exit of the X-radiation 16. This orifice 14 is tightly sealed with the aid of a thin, tight wall 18 and made from a material transparent to the X-rays produced.

The nature of the material constituting the anode determines the spectrum of the X-radiation emitted by said anode, as well as the bremsstrahlung of the electrons emitted by the cathode and to which reference will be made hereinafter.

A material is chosen for the cathode which is able to easily supply electrons, such as e.g. copper or graphite and a metallic material is chosen for the anode, such as e.g. copper, molybdenum, tungsten or silver.

The relative position of the anode and the cathode determines the shape of the X-ray emission lobe and the spatial distribution of said X-rays.

The spacing E between the anode and the cathode can be made regulatable. The anode 10 can be made rotary by providing it with a rotation means symbolized by the arrow F in FIG. 1. Moreover, the anode 10 can be provided with cooling means R using the circulation of an appropriate fluid.

The cable generator 6 incorporates at least two electric lines, preferably constituted by flexible, coaxial cables (whereof six are provided in the example shown in FIG. 1 and respectively carry the references C1, C2, C3, C4, C5 and C6).

Each coaxial cable comprises a first electrical conductor A called the "core" and a second electrical conductor T called the "braid", which surrounds the core A and is separated therefrom by a dielectric D. Moreover, the braid of each cable is surrounded by a not shown, electrically insulating envelope.

Flexible, coaxial cables are connected in parallel to the electric pulse production means 2 and connected in series to the emitting head.

More specifically, on the side of the electric pulse production means 2, the ends of the cores of the coaxial cables are electrically interconnected, as well as being connected to the terminal a of the capacitor S2.

On the same side, the braids of the coaxial cables are electrically interconnected, as well as being connected to the terminal b of the capacitor S1, the common terminal for the capacitors S1 and S2 carrying the reference c, as can be seen in FIG. 1.

On the other side of the cable generator 6, i.e. on the side of the emitting head 4, the end of the core of the coaxial cable C6 is electrically connected to the anode 10, whilst the end of the braid of the coaxial cable C1 is electrically connected to the cathode 12 and the end of the braid of the coaxial cable C6 is electrically connected to the end of the core of the coaxial cable C5, whilst the end of the braid of the coaxial cable C5 is electrically connected to the end of the core of the coaxial cable C4, etc. and the end of the braid of the coaxial cable C2 is electrically connected to the end of the core of the coaxial cable C1.

The use of such a cable generator 6 makes it possible to obtain extremely fast electric discharges with a very high voltage (a few kV to 240 kV in the example shown), the duration of the pulses being below 25 ns.

The discharger or trigger TH makes it possible to release the electric power stored in the capacitors S1 and S2 and transfer part of said power to the cable generator 6.

This cable generator 6 permits the multiplication of the voltage of the pulse supplied by the means 2, the multiplication factor being a function of the number of flexible, coaxial cables.

In the embodiment shown with six coaxial cables and a voltage of 10 kV at the input of the cable generator, there is a voltage of 60 kV between the anode and the cathode of the X-ray emitting head.

A voltage of 80 kV would be obtained by using eight coaxial cables and the same input voltage of 10 kV, or by using six coaxial cables, but an input voltage of 13.3 kV.

Under the effect of the high voltage electric pulse reaching the emitting head 4, electrons are very rapidly emitted by the cathode 12 (in the form of pulses, whose duration is approximately 10 to 25 ns as a function of the residual pressure in the emitting head 4) and undergo bremsstrahlung on reaching the anode 10.

There is then an emission of X-rays characteristic of the material constituting the anode 10 and an emission of X bremsstrahlung.

Figure 2:
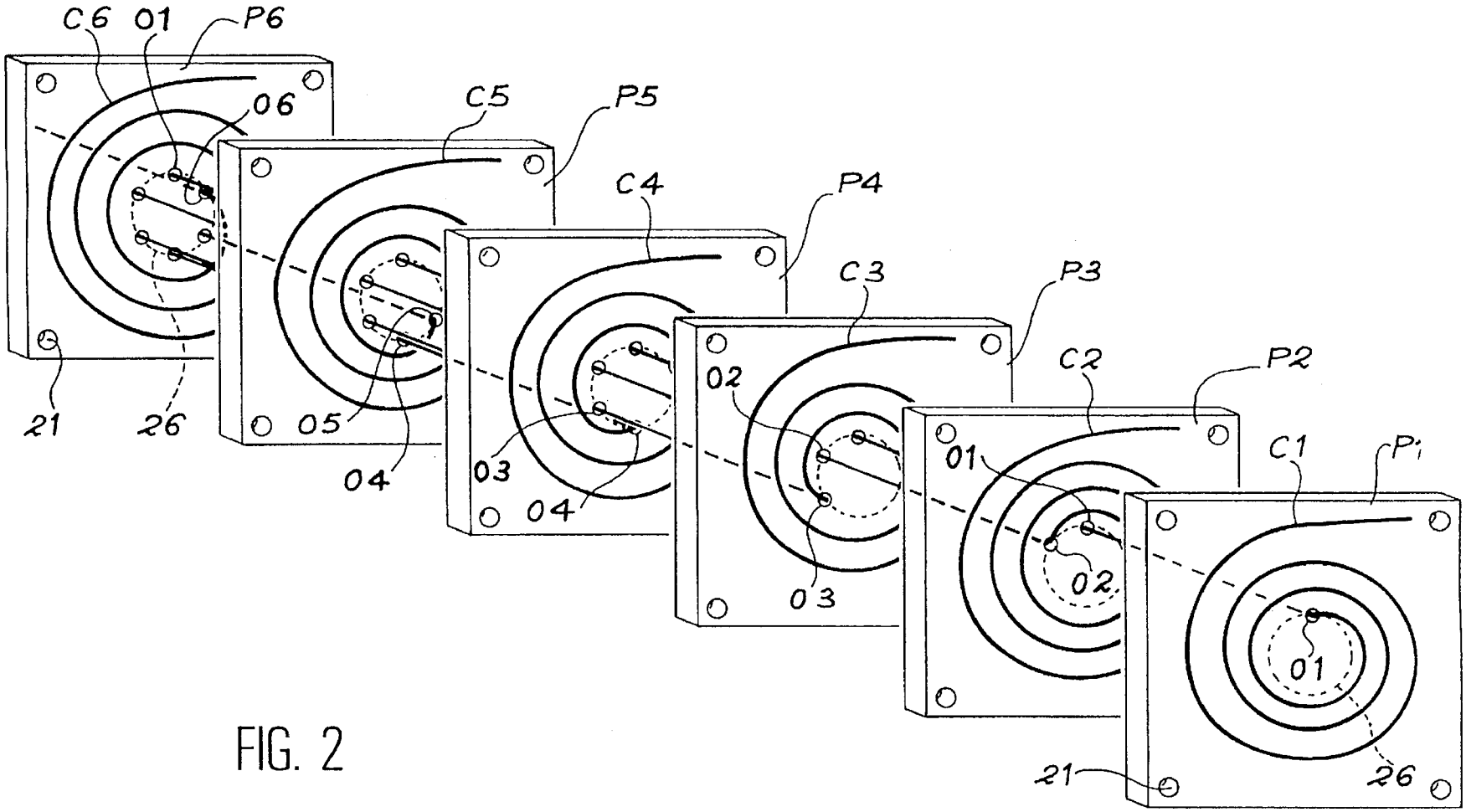
FIG. 2 A diagrammatic view of electrically insulating plates carrying spirally wound, flexible, coaxial cables usable in a generator according to the invention.
Figure 3:
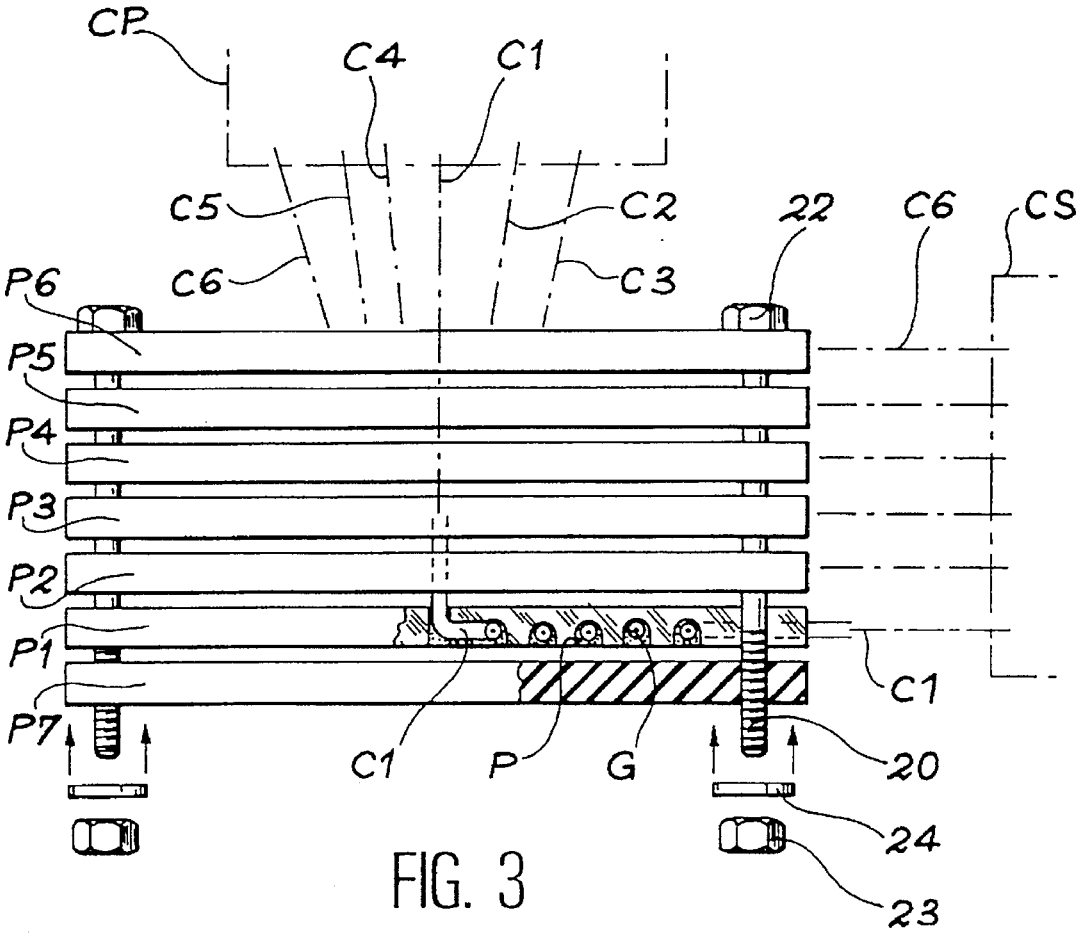
FIG. 3 An assembly of said plates.

FIGS. 2 and 3 illustrate the arrangement of the coaxial cables C1 to C6. These coaxial cables C1 to C6 are respectively installed on electrically insulating plates P1 to P6 (e.g. of polyvinyl chloride). More specifically each flexible, coaxial cable is wound onto the plate associated therewith.

In the embodiment shown, each coaxial cable is spirally wound in a groove G (FIG. 3) provided for this purpose on one face of the corresponding plate.

The plates P1 to P6 are stacked from plate P1 to plate P6, as can be seen in FIG. 3, which is a plan view of the stack obtained. The faces of the plates carrying the spiral grooves G are all turned towards the same side of the stack.

Moreover, an electrically insulating, protective plate P7, e.g. of polyvinyl chloride, is positioned facing the face of the plate P1 carrying the corresponding spiral groove.

The plates P1 to P7 are pressed against one another (so that there is no air between them, which limits the corona effect), by means of appropriate means which, in the embodiment shown in FIG. 3, are electrically insulating, threaded rods 20, e.g. of polyvinyl chloride, which pass through aligned holes 21 of the plates P1 to P6, the end of each rod located on the side of the plate P6 being equipped with a head 22 bearing against said plate P6, whereas the other end of each threaded rod is provided with a nut 23 used for locking the plates against one another by means of an electrically insulating washer 24, such as is the case with nut 23 and head 22.

In order to further reduce corona effects and improve the efficiency of the generator, the coaxial cables are coated in their respective grooves with an electrically insulating paste P, e.g. of silicone.

On the side of the parallel connections of the flexible, coaxial cables and which are symbolized by dotted lines CP in FIG. 3, the entry of said cables up to their respective plates takes place through orifices formed in the central portion of the plates P1 to P6.

As can be seen in FIG. 3, the six cables arrive from their connections in parallel towards the face of the plate P6 not having a groove.

FIG. 2 shows that the plate P1 has an orifice O1, the plate P2 two orifices O1 and O2, etc. and the plate P6 six orifices O1 to O6.

The orifices carrying the same reference are aligned and all the references are located on a same cylinder of revolution, whose dotted line, circular outline 26 can be seen on each of the plates. The distance between two adjacent holes is the same for each of the plates.

The coaxial cables arrive at the central portion of the assembly of the plates and the spiral development of each cable takes place on moving away from the center of the corresponding plate, as can be seen in FIG. 2. Thus, the cable C1 traverses the six openings O1 and is then spirally wound on the plate P1, the cable C2 traverses the five openings O2 and is wound onto the plate P2, etc. and the cable C6 traverses the opening O6 and is wound onto the plate P6.

In order to obtain a good quality factor and X-ray pulses of short duration, the flexible, coaxial cables all have the same length.

In order to achieve this, bearing in mind the different thicknesses of the assembly of plates which the cables C1 to C6 have to traverse, the length of the spiral portion closest to the centre of a plate is calculated as a function of the thickness of the assembly to be traversed for the corresponding cable.

This is illustrated in FIG. 2, where it is possible to see that said portion increases from cable C1 to cable C6, so that there is a greater length for the cable C1, enabling the latter to traverse the assembly than for the cable C6, which is the closest to the parallel connections of the coaxial cables.

As has been shown, the other ends of the coaxial cables are connected in series, which is symbolized by the dotted line CS of FIG. 3.

On the side of this series connection, part of each winding can be left free, the resulting flexibility permitting an exceptional mobility of the X-ray emitting head.

It is pointed out that it is necessary to have an adequate insulating material thickness between the adjacent cables and between the adjacent turns of the spiral of each cable so as not to have an electric breakdown during the operation of the generator.

For the same electric power consumption of 3 W, the above-described generator with reference to FIGS. 1 to 3 leads to an exposure time of 20 ns, whereas a conventional generator (X-ray tube) requires an exposure time of 6 s for the same X-radiation dose received at the same distance.

Figure 4:
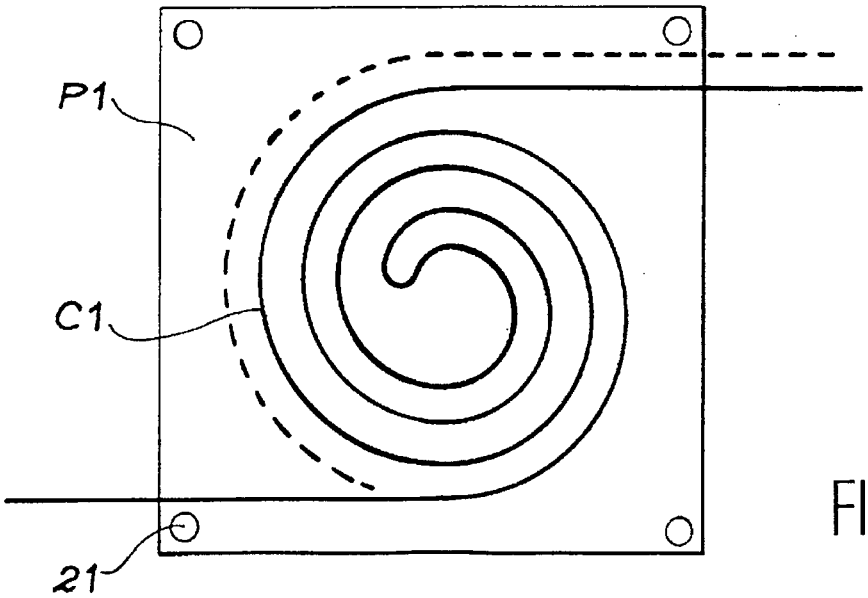
FIG. 4 A diagrammatic view of an electrically insulating plate carrying a flexible, coaxial cable wound in double spiral form and usable in another generator according to the invention.

In a constructional variant diagrammatically illustrated by FIG. 4, each of the flexible, coaxial cables, such as the cable C1, is wound in double spiral form in the manner shown in FIG. 4, in a groove provided for this purpose on one face of the corresponding plate.

Thus, the two ends of the cable lead to two opposite sides of the plate and the electrical connections between the cables occur in the manner described relative to FIG. 1, which is simpler with such double spiral windings than with single spiral windings as shown in FIG. 2.

It is also possible to produce the double spiral to arrive at the two ends of the flexible cable on the same side of the plate, as shown in dotted line form in FIG. 4.

Figure 5:
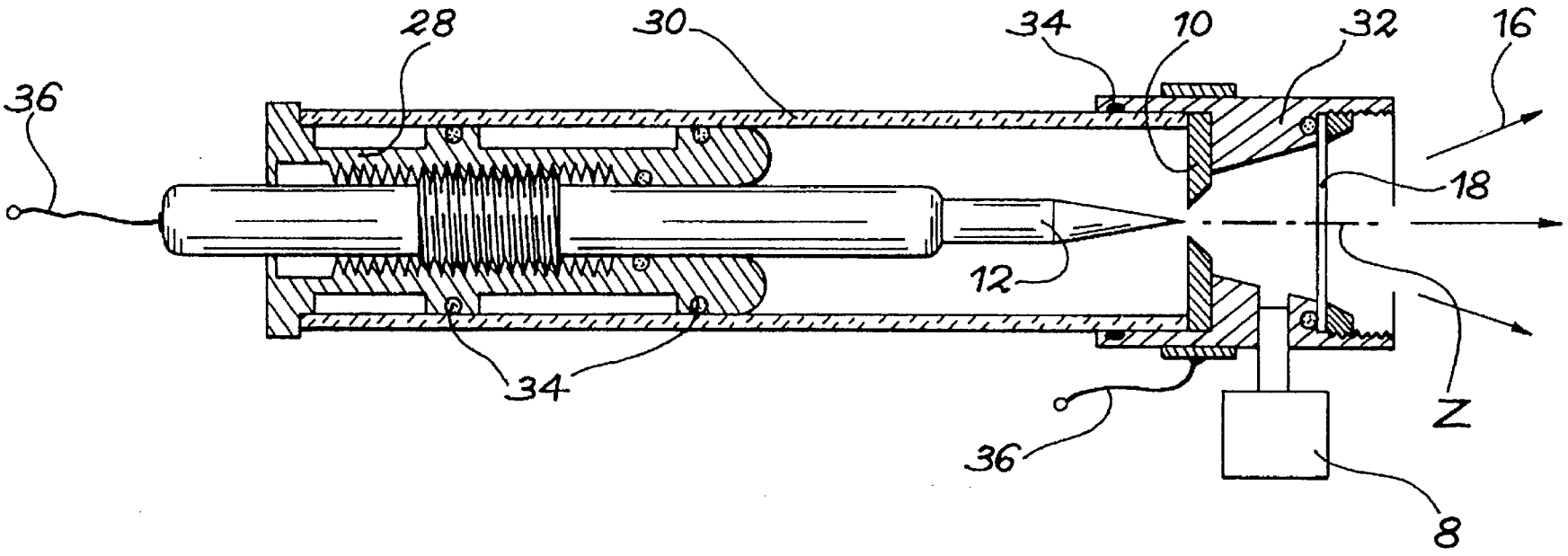
FIG. 5 A diagrammatic view of a constructional variant of the emitting head of the generator according to the invention.

FIG. 5 is a diagrammatic view of another embodiment of a X-ray emitting head.

The emitting head of FIG. 5 has a symmetry of revolution about an axis Z and comprises an annular anode 10 with a perforation along axis Z, as well as an elongated cathode 12 along axis Z and terminated by a point facing the perforation of the anode.

The cathode 12 is regulatable in translation along the axis Z in an internally threaded part 28, the cathode having a corresponding external thread. Said part 28 is located in an electrically insulating tube 30 of axis X, whereof one end is closed by an external shoulder of the part 28, whereas the other end of the tube 30 is closed by the anode 10.

On the side thereof, the emitting head is extended by a tubular, electrically conductive part 32 of axis X, which is in contact with the anode and tightly sealed by a thin wall 18 transparent to the X-rays produced and which defines a zone communicating with pumping means 8 permitting the formation of a vacuum in the emitting head, the parts 28 and 30 having seals 34 for maintaining the vacuum.

FIG. 5 also shows the electrical conductors 36 by means of which the anode and cathode are connected to the cable generator 6.

The generator according to the invention, described with reference to FIGS. 1 to 5, can be reduced to a size and weight compatible with a use as a portable generator.

We claim:

1. A X-ray pulse generator comprising:

a high voltage source (HT), a X-ray emitting head (4) able to produce X-rays when it receives an electric pulse, a plurality of electric lines (C1 to C6) between the high voltage source and the X-ray emitting head, each electric line comprising a first electrical conductor (A) and a second electrical conductor (T) separated by a dielectric (D), means (S1, S2) for storing the electric power supplied by the high voltage source (HT) and triggering means (TH) provided for releasing the electric power stored in the storage means (S1, S2) and for triggering the electric pulse, which is then transferred to the X-ray emitting head (4) by said plurality of electric lines (C1 to C6), said electric lines being wound and on one side being connected in parallel to the electric power storage means (S1, S2) and on the other side being connected in series to the X-ray emitting head (4).

2. The generator according to claim 1, characterized in that all the electric lines (C1 to C6) have the same length.

3. A X-ray pulse generator comprising:

a high voltage source (HT), a X-ray emitting head (4) able to produce X-rays when it receives an electric pulse, a plurality of electric lines (C1 to C6) between the high voltage source and the X-ray emitting head, each electric line comprising a first electrical conductor (A) and a second electrical conductor (T) separated by a dielectric (D), means (S1, S2) for storing the electric power supplied by the high voltage source (HT), triggering means (TH) provided for releasing the electric power stored in the storage means (S1, S2) and for triggering the electric pulse, which is then transferred to the X-ray emitting head (4) by said plurality electric lines (C1 to C6), said electric lines being wound and on one side being connected in parallel to the electric power storage means (S1, S2) and on the other side being connected in series to the X-ray emitting head (4), and a plurality of electrically insulating, parallel supports (P1 to P6), which are juxtaposed and respectively associated with the wound electric lines (C1 to C6), each support having a groove (G) in which the corresponding electric line is wound.

4. Generator according to claim 3, characterized in that it also comprises means (20, 22, 23, 24) for pressing the supports (P1 to P6) against one another.

5. The generator according to claim 4, characterized in that, in the grooves (G), the lines are coated with an electrically insulating material (P).

6. The generator according to claim 1, characterized in that each line (C1 to C6) is spirally wound.

7. The generator according to claim 1, characterized in that each line (C1 to C6) is wound in double spiral form.

8. The generator according to claim 1, characterized in that each line is a flexible, coaxial cable (C1 to C6), the first and second electrical conductors of said line being respectively constituted by the core (A) and the braid (T) of said coaxial cable.

9. The generator according to claim 3, characterized in that each line (C1 to C6) is spirally wound, in that each line is a flexible, coaxial cable, the first and second electrical conductors of said line being respectively constituted by the core (A) and the braid (T) of said coaxial cable, in that the spiral winding of each cable takes place on moving towards the centre of the corresponding support (P1 to P6) and in that the supports are perforated in their central portion in order to permit the passage of cables from the side where the cables are connected to the electric power storage means (S1 to S3) to the supports (P1 to P6) respectively corresponding thereto.

10. The generator according to claim 8, characterized in that a portion of the flexible, coaxial cables connected to the X-ray emitting head (4) is left free to permit the mobility of said emitting head with respect to the remainder of the generator.

11. A generator according to claim 9 characterized in that a portion of the flexible, co-axial cables connected to the X-ray emitting head (4) is left free to permit the mobility of said emitting head with respect to the remainder of the generator.

* * * * *